US008929757B2

(12) United States Patent
Shirafuji et al.

(10) Patent No.: US 8,929,757 B2
(45) Date of Patent: Jan. 6, 2015

(54) IMAGE FORMING APPARATUS FOR DETECTING AND CORRECTING THICKNESS AND AREA RATIO OF TONER LAYER

(75) Inventors: Yasuhito Shirafuji, Kashiwa (JP); Tomohisa Itagaki, Abiko (JP); Nobuhiko Zaima, Kashiwa (JP); Takahiro Ishihara, Maebashi (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 13/489,574

(22) Filed: Jun. 6, 2012

(65) Prior Publication Data

US 2012/0321331 A1 Dec. 20, 2012

(30) Foreign Application Priority Data

Jun. 15, 2011 (JP) ..... 2011-133537

(51) Int. Cl.
*G03G 15/01* (2006.01)
*G03G 15/043* (2006.01)
*G03G 15/00* (2006.01)

(52) U.S. Cl.
CPC .. *G03G 15/5054* (2013.01); *G03G 2215/00029* (2013.01); *G03G 15/043* (2013.01); *G03G 15/5058* (2013.01); *G03G 15/5025* (2013.01)
USPC ..... 399/49

(58) Field of Classification Search
USPC ..... 399/49, 51
See application file for complete search history.

(56) References Cited

U.S. PATENT DOCUMENTS

| | | | | |
|---|---|---|---|---|
| 6,898,381 | B2 | 5/2005 | Maebashi et al. | |
| 7,782,355 | B2 | 8/2010 | Oki | |
| 7,940,418 | B2 | 5/2011 | Eom | |
| 8,102,563 | B2 | 1/2012 | Eom | |
| 2003/0118361 | A1 * | 6/2003 | Shimmura | 399/49 |
| 2008/0285991 | A1 | 11/2008 | Oki | |
| 2010/0098441 | A1 | 4/2010 | Miyazaki et al. | |
| 2012/0106997 | A1 | 5/2012 | Aoki | |

FOREIGN PATENT DOCUMENTS

| | | | |
|---|---|---|---|
| CN | 1417650 | A | 5/2003 |
| CN | 1719345 | A | 1/2006 |
| CN | 1924721 | A | 3/2007 |

(Continued)

OTHER PUBLICATIONS

Communication dated Oct. 29, 2012, forwarding a European Search Report in European Application No. 12169941.7-2216.

(Continued)

*Primary Examiner* — Quana M Grainger
(74) *Attorney, Agent, or Firm* — Fitzpatrick, Cella, Harper & Scinto

(57) ABSTRACT

An image forming apparatus includes an image forming unit having an exposure unit and a developing unit; a detection unit configured to detect a thickness and an area ratio of a toner layer of a pattern image formed by the image forming unit; a storage unit configured to store data indicating permissible ranges for the thickness and the area ratio of the toner layer; and a correction unit configured to change, when the thickness or the area ratio of the toner layer detected by the detection unit falls outside the corresponding permissible range indicated by the data stored in the storage unit, a spot diameter of the laser beam so that the thickness and the area ratio of the toner layer respectively fall within the permissible ranges.

4 Claims, 15 Drawing Sheets

(56) References Cited

FOREIGN PATENT DOCUMENTS

| | | | |
|---|---|---|---|
| CN | 101008809 | A | 8/2007 |
| JP | 11-305515 | A | 11/1999 |
| JP | 2008-281963 | A | 11/2008 |

OTHER PUBLICATIONS

Office Action in Chinese Patent Application No. 201210192790.9, dated Mar. 24, 2014.

* cited by examiner

IMAGE FORMING APPARATUS FOR DETECTING AND CORRECTING THICKNESS AND AREA RATIO OF TONER LAYER

BACKGROUND OF THE INVENTION

1. Field of the Invention

The present invention relates to an image forming apparatus for maintaining a given image quality while suppressing degradation in graininess.

2. Description of the Related Art

Color stability of an output image is required for a color image forming apparatus which adopts an electrophotographic method. If each element of the apparatus varies due to use for many hours or a change in environment, however, the color of an image obtained by the color image forming apparatus also varies.

Japanese Patent Laid-Open No. 11-305515, therefore, proposes a technique of forming the pattern image of a solid image and a halftone pattern image for each color, and detecting the density of each pattern image by an optical sensor, thereby determining the development contrast. Note that the development contrast is an electric potential difference between an exposure electric potential formed on the photosensitive member of an image forming apparatus and a developing electric potential applied to the developing sleeve of a developing apparatus. An electric potential difference between a charging potential on the photosensitive member and the developing potential is referred to as back contrast.

The arrangement described in Japanese Patent Laid-Open No. 11-305515 can detect the width of a toner layer on an image carrier but cannot detect the thickness (height) of the toner layer. Even if the thicknesses of the toner layers of two pattern images are different from each other, therefore, the same density may be detected. In this case, wrong density control is executed, thereby lowering the output image quality.

When the image density is determined to be low, and the exposure light amount or the developing electric potential are controlled to increase the development contrast in order to enhance the image density, the toner amount carried on the photosensitive member increases. At this time, the toner layer on the photosensitive member increases not only in the surface direction of the photosensitive member but also in a direction (thickness direction) perpendicular to the surface. If the toner layer is too thick, toner spreads in the lateral direction when a toner image is transferred from the photosensitive member to an image carrier such as a printing medium or intermediate transfer member, and therefore, an area in which the toner image covers the image carrier becomes larger than a target. As the area in which the toner image covers the image carrier becomes large, the density visually becomes high or the image looks like an image in which the dot size is large, which means that the image quality drops. Furthermore, when forming an image by applying pressure in a transfer unit or fixing unit, a toner image readily spreads by the pressure if the height of the toner image is large, thereby degrading the graininess of the image. Note that the image quality is evaluated based on the graininess.

The graininess is, for example, an RMS graininess expressed by:

$$\text{graininess} = \sqrt{\frac{1}{N}\sum_{i=1}^{N}(Di - \overline{D})^2}$$

where Di represents the density distribution, N represents the number of samples, and $\overline{D}$ represents the average density. Note that as the value of the RMS graininess is larger, the image quality degrades.

SUMMARY OF THE INVENTION

The present invention provides an image forming apparatus which can suppress degradation of an image as compared with a conventional technique.

According to an aspect of the present invention, an image forming apparatus includes an image forming unit having an exposure unit configured to form a latent image by exposing a photosensitive member with a laser beam, and a developing unit configured to form a toner image by causing toner to adhere to the latent image; a detection unit configured to detect a thickness and an area ratio of a toner layer of a pattern image as the toner image formed by the image forming unit; a storage unit configured to store data indicating permissible ranges for the thickness and the area ratio of the toner layer; and a correction unit configured to change, when the thickness or the area ratio of the toner layer detected by the detection unit falls outside the corresponding permissible range indicated by the data stored in the storage unit, a spot diameter of the laser beam so that the thickness and the area ratio of the toner layer respectively fall within the permissible ranges.

Further features of the present invention will become apparent from the following description of exemplary embodiments with reference to the attached drawings.

DESCRIPTION OF THE EMBODIMENTS

Embodiments of the present invention will be described in detail below with reference to the accompanying drawings.

Figure 1:
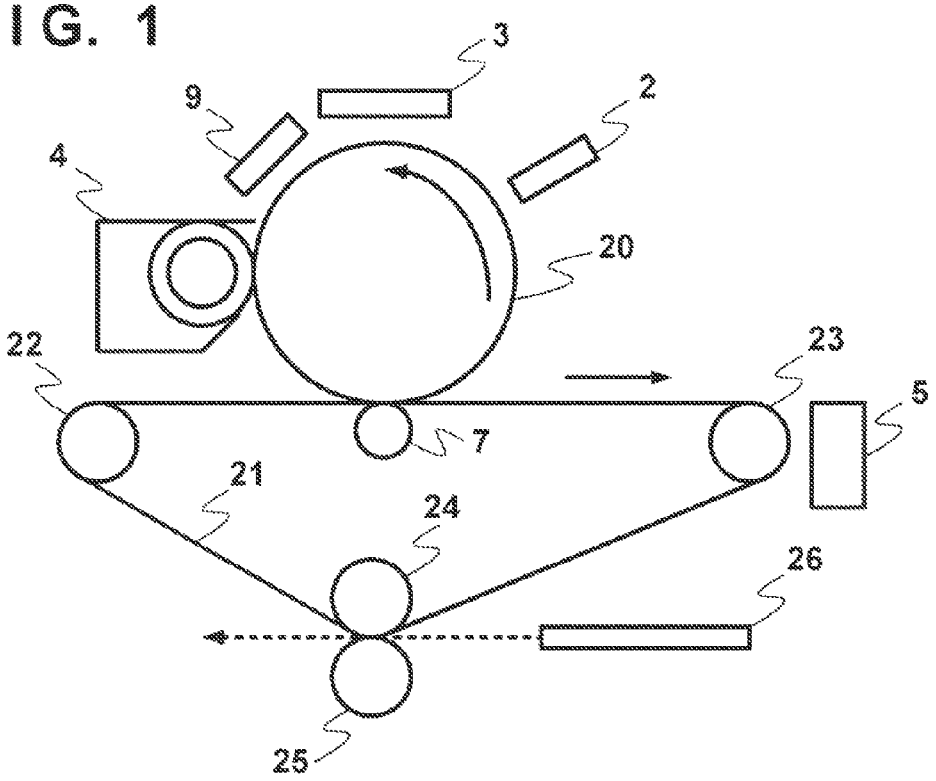
FIG. 1 is a schematic view showing an image forming apparatus according to the first embodiment.

Referring to FIG. 1, a photosensitive drum 20 serving as a photosensitive member is an amorphous silicon drum having a negative charge polarity, which is rotated in the direction of an arrow by an electric motor (not shown). While the photosensitive drum 20 is rotated, a voltage is applied to a charging apparatus 2, thereby causing the surface of the photosensitive drum 20 to have a charging potential. Note that an electric potential sensor 9 for measuring the electric potential of the photosensitive drum 20 is arranged so that the electric potential of the photosensitive drum 20 becomes a target value. An exposure apparatus 3 exposes the photosensitive drum 20 to a laser beam based on image information, thereby forming a latent image corresponding to the image information.

When a power supply (not shown) applies a developing voltage to a developing apparatus 4, the developer of the developing apparatus 4 adheres to a dark portion of the latent image to form by development a toner image on the photosensitive drum 20. On the other hand, an intermediate transfer belt 21 loops around a steering roller 23, a driving roller 22, and a backup roller 24 under the photosensitive drum 20. A primary transfer apparatus 7 transfers the toner image on the photosensitive drum 20 to the surface of the intermediate transfer belt 21. Furthermore, the toner image on the intermediate transfer belt 21 is transferred to a printing material 26 when it passes between the backup roller 24 and a secondary transfer roller 25. A fixing apparatus (not shown) heats and applies pressure to the printing material 26 on which the toner image has been transferred, thereby fixing the toner image on the surface of the printing material 26.

In an image forming apparatus according to the present invention, a toner amount detection unit 5 is arranged to detect the thickness (height) of the toner layer of a pattern image formed on the intermediate transfer belt 21, and the area ratio of the toner layer portion to the area of the whole pattern image.

Figure 2:
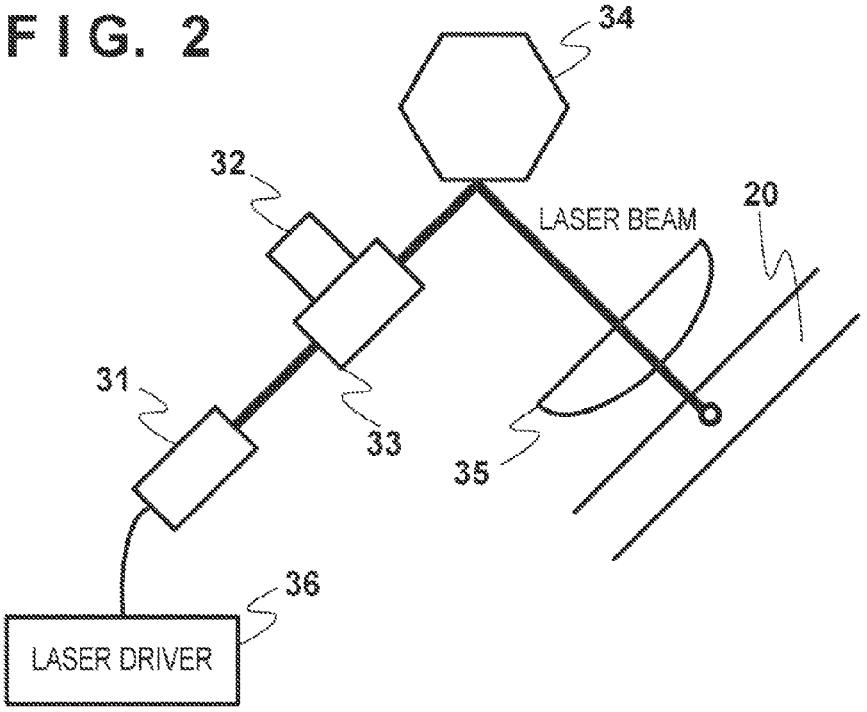
FIG. 2 is a schematic view showing an exposure apparatus according to the first embodiment.

The exposure apparatus 3 will now be described in detail. An exposure light source 31 shown in FIG. 2 serves as, for example, a semiconductor laser having a center wavelength of 680 nm. A laser beam emitted by the exposure light source 31 passes through a collimator lens 33 having a focus adjustment mechanism 32 to be collimated light. The laser beam is reflected by a rotating polyhedral mirror 34, and converges on the photosensitive drum 20 through an f–θ lens 35, thereby forming an exposure spot. With this operation, the exposure apparatus 3 scans the photosensitive drum 20. Note that the exposure light source 31 is connected with a laser driver 36 which controls a laser emission timing and a laser intensity.

Figure 3:
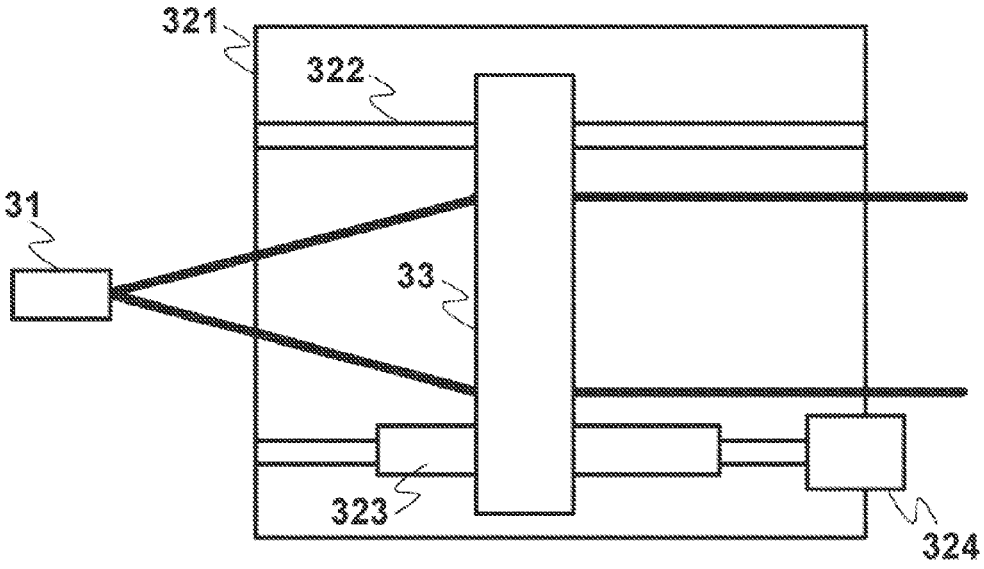
FIG. 3 is a view showing details of a focus adjustment mechanism shown in FIG. 2.

A collimator lens optical system including the focus adjustment mechanism 32 and the collimator lens 33 will be described in detail. Referring to FIG. 3, a frame 321 has hollows in the incident direction and emitting direction of a laser beam from the exposure light source 31. The collimator lens 33 is supported by a guide shaft 322 and lead screw 323, and moves in the direction of the guide shaft 322 as the lead screw 323 rotates. Note that the collimator lens 33 is arranged on the optical path of the laser beam, and is supported so that its focusing direction coincides with the optical-path of the laser beam. The guide shaft 322 is provided so that its axis coincides with the optical-path of the laser beam.

The lead screw 323 is connected with a stepping motor 324, and rotates as the stepping motor 324 rotates. A control signal drives the stepping motor 324 to move the collimator lens 33 along the optical path of the laser beam, thereby enabling to change the spot diameter of an exposure spot on the photosensitive drum 20. Note that the light amount distribution of the exposure spot is Gaussian, and the spot diameter is the diameter of a light amount distribution at $1/(e^2)$ of a peak light amount. Note that e represents the base of the natural logarithm.

Figure 4:
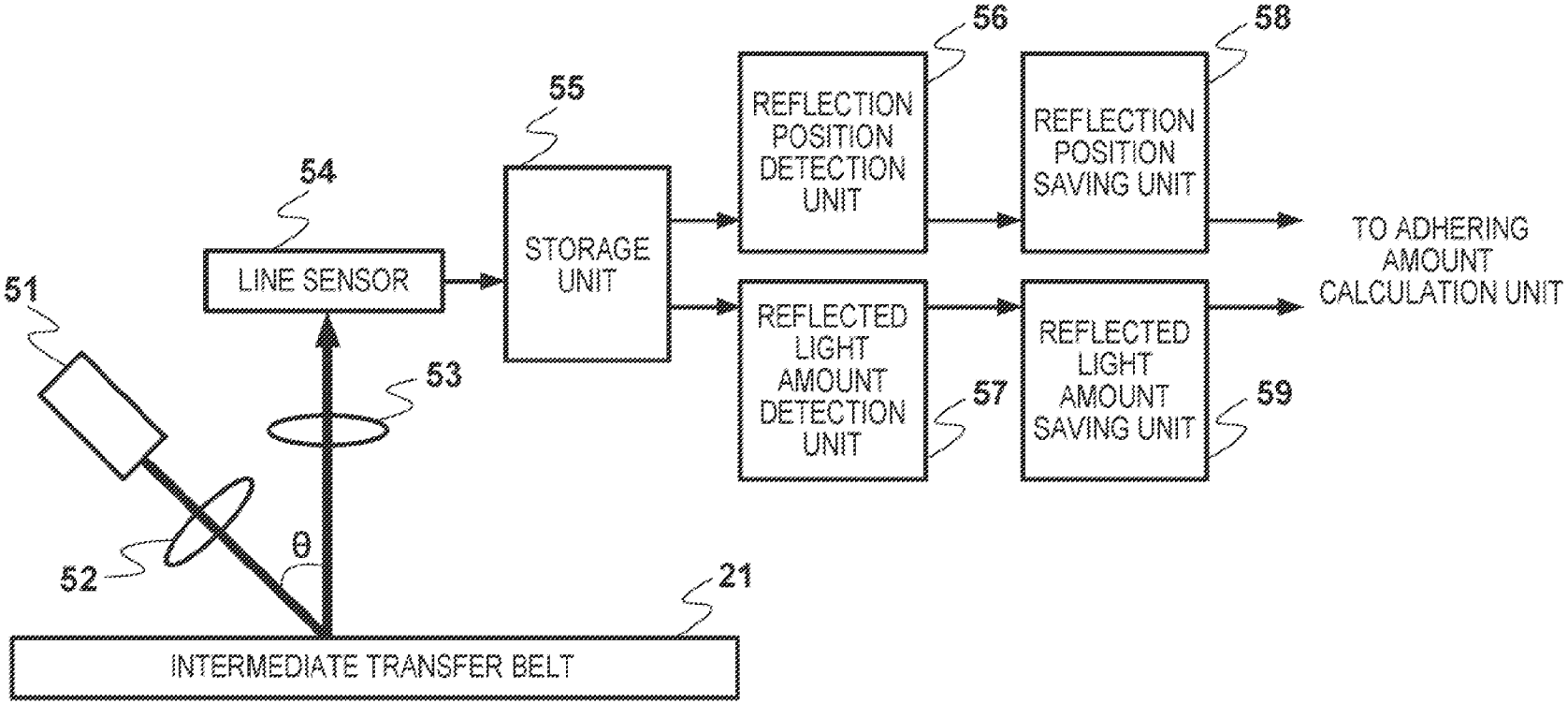
FIG. 4 is a view showing the arrangement of a toner amount detection unit.

The toner amount detection unit 5 will now be described. As shown in FIG. 4, a laser beam emitted by a light source 51 converges on the intermediate transfer belt 21 through a condenser lens 52 to form a spot. Upon being reflected by the intermediate transfer belt 21, the laser beam forms an image on a line sensor 54 through a light-receiving lens 53. The line sensor 54 detects the reflected waveform of the image, converts it into a digital signal, and saves the obtained signal in a storage unit 55. The wavelength of the laser beam is determined based on the absorption characteristics of toner particles, and a light source having a wavelength of about 850 nm can be used for YMC (Yellow, Magenta, and Cyan) toner.

Note that the spot diameter of the laser beam on the intermediate transfer belt 21 is made larger than the distance between the lines or dots of the pattern image. This is because it is impossible to correctly detect the height and area if the spot of the laser beam is reflected between the lines or dots of the pattern image. Assume, for example, that the smallest number of lines of a line screen is 100 lpi. In this case, the distance between the lines or dots of the pattern image can be about 125 μm. In this case, therefore, the spot diameter of the laser beam is set to about 500 μm.

In this embodiment, the light source 51 is arranged so that an incident angle θ with respect to the intermediate transfer belt 21 becomes 45°. The line sensor 54 is arranged at an angle of 90° with respect to the surface of the intermediate transfer belt 21. The arrangement angle, however, is not limited to this.

A reflection position detection unit 56 determines a position (peak position) at which the light amount or the reflected waveform saved in the storage unit 55 is largest, and saves the determined peak position in a reflection position saving unit 58. Note that the reflection position detection unit 56 saves the peak position of reflected light at a position of the intermediate transfer belt 21 where there is no pattern image, and the peak position of a reflected light amount at the position of the pattern image. A reflected light amount detection unit 57 calculates a reflected light amount based on the peak area of the reflected waveform saved in the storage unit 55, and saves the calculated reflected light amount in a reflected light amount saving unit 59. Note that the reflected light amount saving unit 59 saves a reflected light amount at a position of the intermediate transfer belt 21 where there is no pattern image, and a reflected light amount at the position of the pattern image.

It is possible to obtain the peak position and peak area by performing curve fitting by the least squares method using a Gaussian function, and then performing forecasting calculation using the parameters of the Gaussian function undergone the fitting. The Gaussian function has an inverted U-shaped peak with a center of x=μ, as expressed by:

$$f(x) = \frac{A}{\sqrt{2\pi\sigma^2}}\exp\left\{-\frac{(x-\mu)^2}{2\sigma^2}\right\} + C \quad (1)$$

where μ represents the peak position, A represents the increase/decrease in height or width of the peak, σ represents the standard deviation, and C represents the offset of the height of the peak.

More specifically, the parameters A, C, σ, and μ in equation (1) which minimize an error with respect to the reflected waveform data saved in the storage unit 55 are obtained, the parameter μ is used as a peak position, and the parameter A is used as a reflected light amount.

Note that fitting may be performed using not the Gaussian function but a Lorentz function expressed by:

$$f(x) = \frac{2A}{\pi}\cdot\frac{w}{4(x-x_c)^2 + w^2} + C \quad (2)$$

where $x_c$ represents the peak position, w represents the half width, A represents the height of the peak, and C represents the offset.

Note that for equation (2), the parameters A, C, $x_c$, and w which minimize an error with respect to the reflected waveform data saved in the storage unit 55 are obtained, the parameter $x_c$ is used as a peak position, and the parameter A is used as a reflected light amount. Furthermore, it is possible to use a quadratic function, and it is possible to perform a maximum value detection.

Figure 5A:
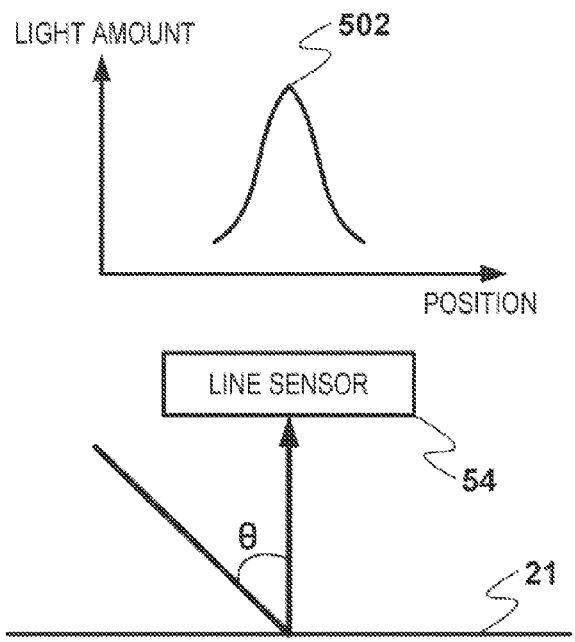
FIGS. 5A and 5B are views for explaining the principles of height detection.
Figure 5B:
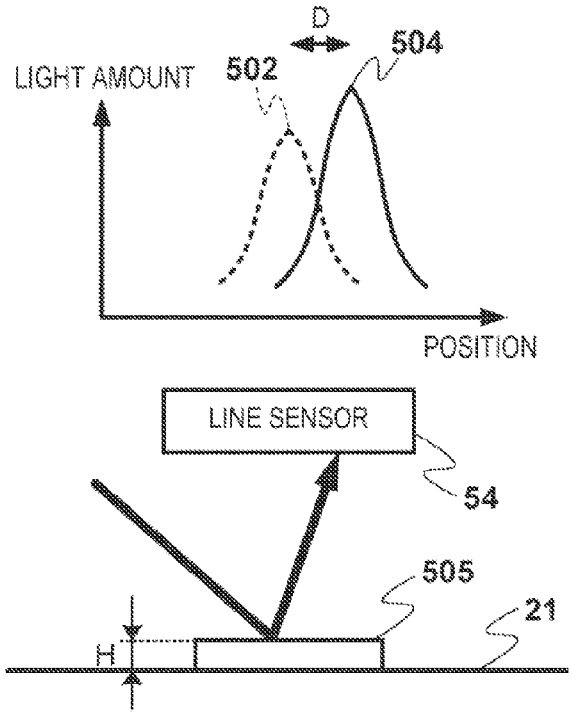

Assume that a peak position 502 has been obtained by irradiating, with a laser beam, a region of the surface of the intermediate transfer belt 21 where no pattern image is formed, as shown in FIG. 5A. Assume also that a peak position 504 has been obtained by irradiating a pattern image 505, as shown in FIG. 5B. In this case, it is possible to obtain a height H of the toner layer of the pattern image 505 using:

$$H=D/(N\cdot\tan\theta)$$

where D represents the difference between the peak positions 502 and 504, N represents the magnification of the light-receiving lens 53, and θ represents the incident angle of the laser beam. Note that the peak position corresponds to the position of a sensor, among the sensors of the line sensor, which has a largest received light amount.

Figure 20:
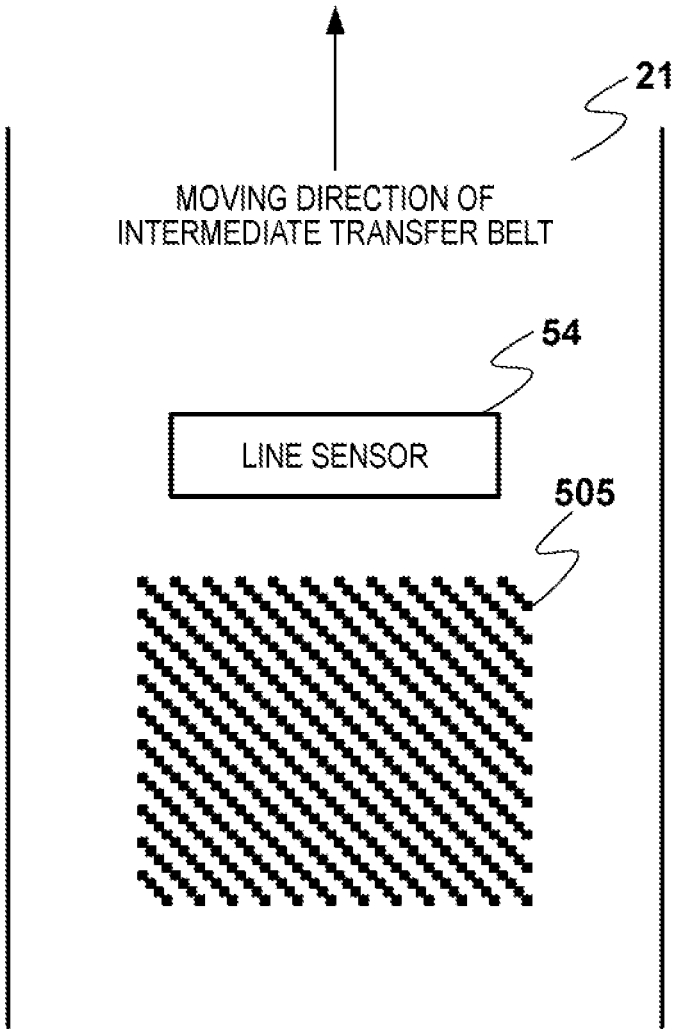
FIG. 20 is a view showing a pattern image.

Since a change in reflected light amount depends on an area ratio S of the dots of the pattern image 505, it is possible to calculate the area ratio S of the dots of the pattern image 505 based on a change in reflected light amount. FIG. 20 shows the pattern image 505. As shown in FIG. 20, the pattern image 505 includes, for example, lines each formed by dots arranged at an angle of 45° with respect to the moving direction of the intermediate transfer belt 21. Note that a line interval is made smaller than the spot size of the laser beam, as described above. With respect to a reflected light amount at a position where there is no pattern image 505, a decrease in light amount when the line sensor 54 receives reflected light from the pattern image is due to the toner layer of the pattern image 505, and depends on the area ratio of the toner layer. That is, as the interval between the lines is made smaller and the area ratio of the toner layer is made larger, the reflected light amount decreases. To the contrary, as the interval between the lines is made larger and the area ratio of the toner layer is made smaller, the reflected light amount increases. This enables to obtain a toner layer adhering amount V=S×H per unit area of the pattern image. Note that the toner amount detection unit 5 may obtain not the toner amount of the intermediate transfer belt 21 but the toner amount of the photosensitive drum 20.

Figure 6:
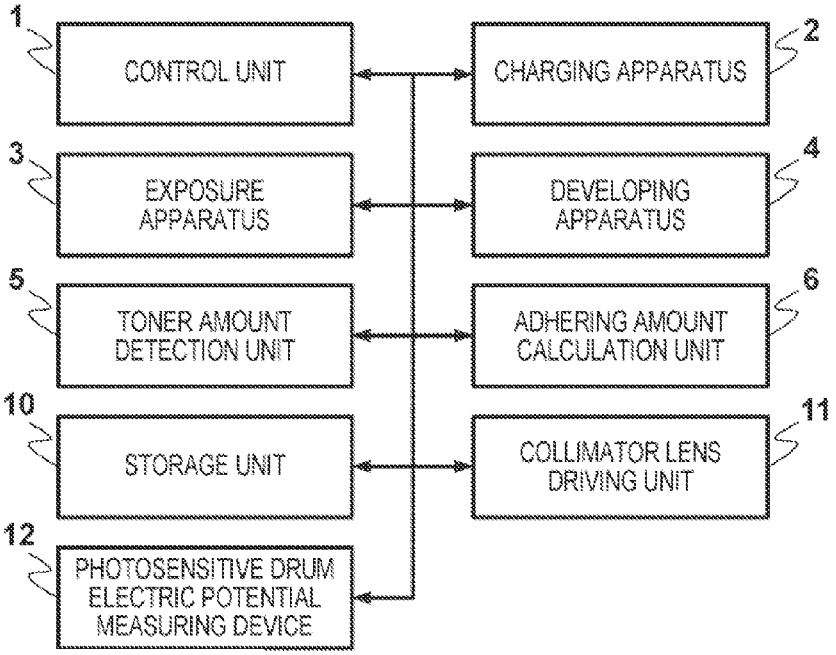
FIG. 6 is a schematic functional block diagram showing the image forming apparatus according to the first embodiment.

In a functional block diagram shown in FIG. 6, a control unit 1 controls the image forming apparatus of the present embodiment as a whole, and starts to form an image when a print signal is input to the control unit 1. The control unit 1 also performs an image density control operation and a toner amount control operation before an image is formed or when a predetermined number of paper sheets are printed during a continuous operation. Note that the user can operate to start the image density control operation and the toner amount control operation. In this embodiment, the control unit 1 forms, with the focus adjustment mechanism 32 and the collimator lens 33, a correction unit for changing the spot diameter of the laser beam. An adhering amount calculation unit 6 detects a toner amount based on the data saved in the reflection position saving unit 58 and reflected light amount saving unit 59, as described above. Note that a storage unit 10 holds the relationship between an exposure spot diameter by the exposure apparatus 3 and the position of the collimator lens 33, and a conversion table between an image density and an exposure amount. The storage unit 10 also holds an exposure spot diameter when the control operations were performed last time, and information about a voltage applied to the charging apparatus 2 and developing apparatus 4. A collimator lens driving unit 11 drives the collimator lens 33 of the exposure apparatus 3 under control of the control unit 1. Furthermore, a photosensitive drum electric potential measuring device 12 measures the charging potential of the photosensitive drum 20.

Figure 7:
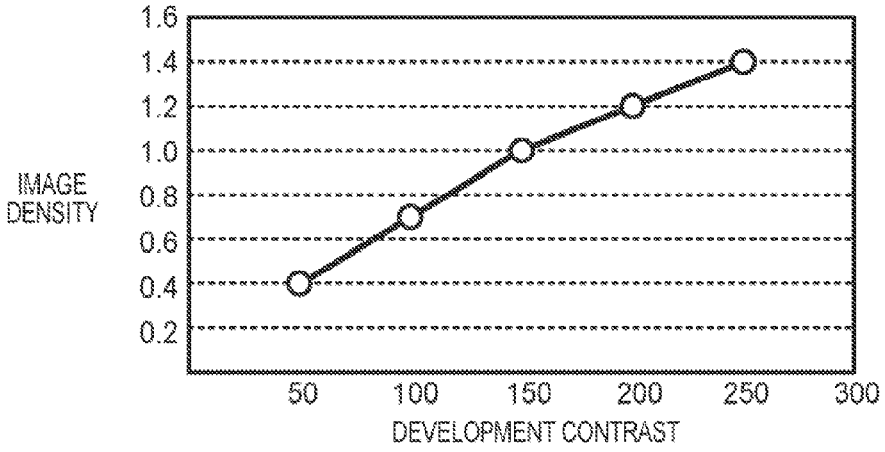
FIG. 7 is a graph showing the relationship between a development contrast and an image density.

The toner amount control operation will be described. Note that in this embodiment, an image density is adjusted before performing the toner amount control operation. More specifically, for example, the pattern image of a solid image is formed, and the relationship between the development contrast and the image density as shown in FIG. 7 is obtained, thereby setting an appropriate development contrast.

Upon start of image formation, the charging apparatus 2 and the photosensitive drum electric potential measuring device 12 operate to charge the photosensitive drum 20 to have a predetermined potential. After that, in step S81 of FIG. 8, the developing apparatus 4 and the primary transfer apparatus 7 operate to form a pattern image having a density of 50% on the intermediate transfer belt 21. As a pattern image, 141 lines with an angle of 45° with respect to the moving direction of the intermediate transfer belt 21 are used. Note that pattern image formation conditions are determined by the last toner amount control operation, and a value saved in the storage unit 10 is used. In step S82, the adhering amount calculation unit 6 calculates the area ratio and the height of the toner layer of the pattern image based on the data obtained by the toner amount detection unit 5. In step S83, the control unit 1 determines whether the calculated area ratio and height respectively meet criteria saved in the storage unit 10. More specifically, if each of the area ratio and the height falls within a permissible range defined by the minimum value and the maximum value, it is determined that they meet the criteria. Note that the maximum value and the minimum value are determined in advance based on the relationship between the graininess and each of the height and the area ratio of the toner layer.

Figure 9:
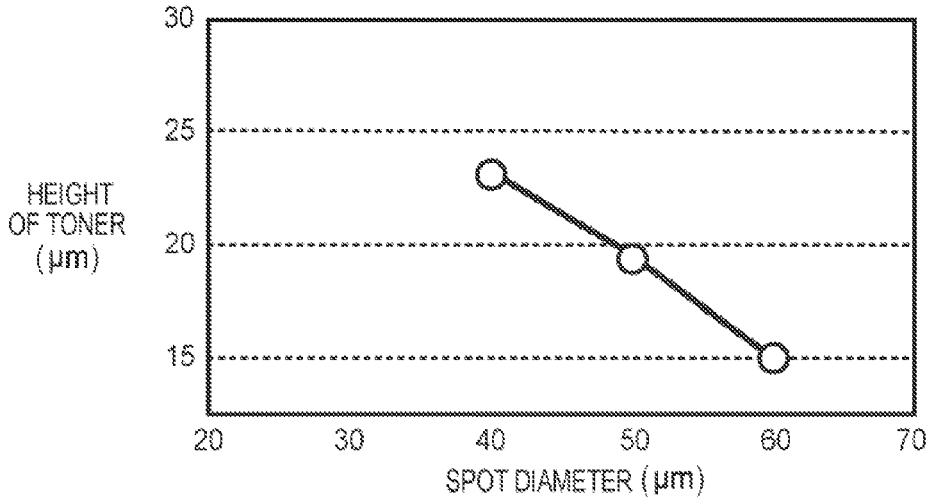
FIG. 9 is a graph showing the relationship between the height of toner and the spot diameter of an exposure spot.

If the criteria are not met, in step S84 the control unit 1 changes the spot diameter of the exposure apparatus 3 and evaluates the relationship between the spot diameter and each of the height and the area ratio of the toner layer. More specifically, the control unit 1 moves the collimator lens 33 of the exposure apparatus 3 in the optical-axis direction of the collimator lens 33, and forms the pattern image by increasing/decreasing the spot diameter from the current setting by a predetermined value, thereby measuring the height and the area ratio of the toner layer. The control unit 1 repeatedly adjusts the spot diameter until each of the height and the area ratio of the toner layer falls within the permissible range. FIG. 9 is a graph showing the relationship between the spot diameter and the height of the toner layer. Note that as the relationship shown in FIG. 9 changes due to a change in film thickness of the photosensitive drum 20 or a change in developability, it is necessary to check the relationship for each control operation.

In step S85, the control unit 1 determines a spot diameter based on the evaluation result such that each of the area and the height falls within the permissible range, and controls the collimator lens 33 to obtain the determined spot diameter. Note that the control unit 1 adjusts the height and the area ratio of the toner layer so that a change amount of a toner amount V (area ratio S×height H) per unit area after the adjustment with respect to a toner amount before the adjustment is equal to or smaller than a threshold. This is because the adjusted image density corresponds to the toner amount, and controlling only one of the height and the area ratio changes the image density.

Figure 10:
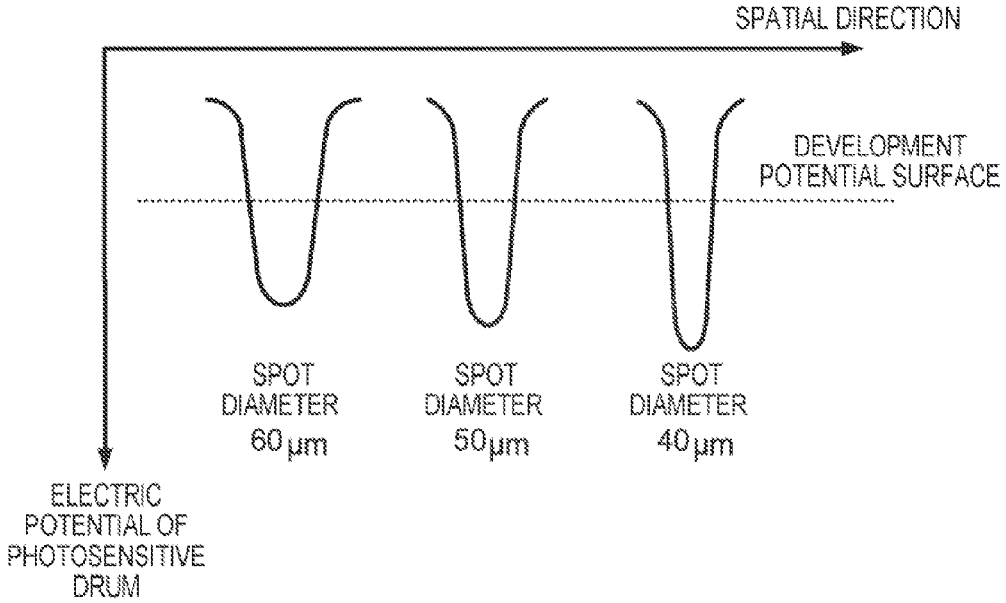
FIG. 10 is a graph showing the relationship between a latent image profile and the spot diameter of an exposure spot.

In this embodiment, changing the spot diameter of the exposure apparatus 3 controls a latent image profile of one dot, that is, the area ratio and the height. The influence of the spot diameter of the exposure apparatus 3 that acts on the latent image profile will now be described. A simulation result for the latent image profile when the spot diameter of the exposure apparatus 3 is set to 40, 50, and 60 μm will be described first. Assume that the film thickness of the photosensitive drum 20 is fixed at 25 μm. Furthermore, an exposure condition in the simulation is that the development contrast for solid black is invariable for each spot diameter. FIG. 10 shows the result.

As shown in FIG. 10, as the spot diameter is smaller, the latent image has a profile which, in turn, has a larger gradient on the development potential surface and a larger depth with respect to the development potential surface. That is, as the spot diameter is made smaller, the area of a toner layer forming one dot becomes smaller and the height of the toner layer becomes higher. This is because the gradient of an exposure profile at a certain exposure intensity becomes larger and a peak light amount also becomes larger by making the spot diameter smaller. That is, since the number of excited carriers generated in the charge generation layer of the photosensitive drum 20 depends on the exposure intensity, the peak light amount and the gradient of the exposure profile are reflected on the peak value and the gradient of an excited carrier distribution generated in the charge generation layer. It is, therefore, possible to change the area ratio and the height with the exposure spot diameter without changing, so much, the toner amount V=the area ratio S×the height H per unit area. Note that if it is impossible to change both the area ratio and the height to fall within the permissible ranges while keeping the change amount of the toner adhering amount equal to or smaller than the threshold, a method of the second embodiment (to be described later) is also used.

Figure 11:
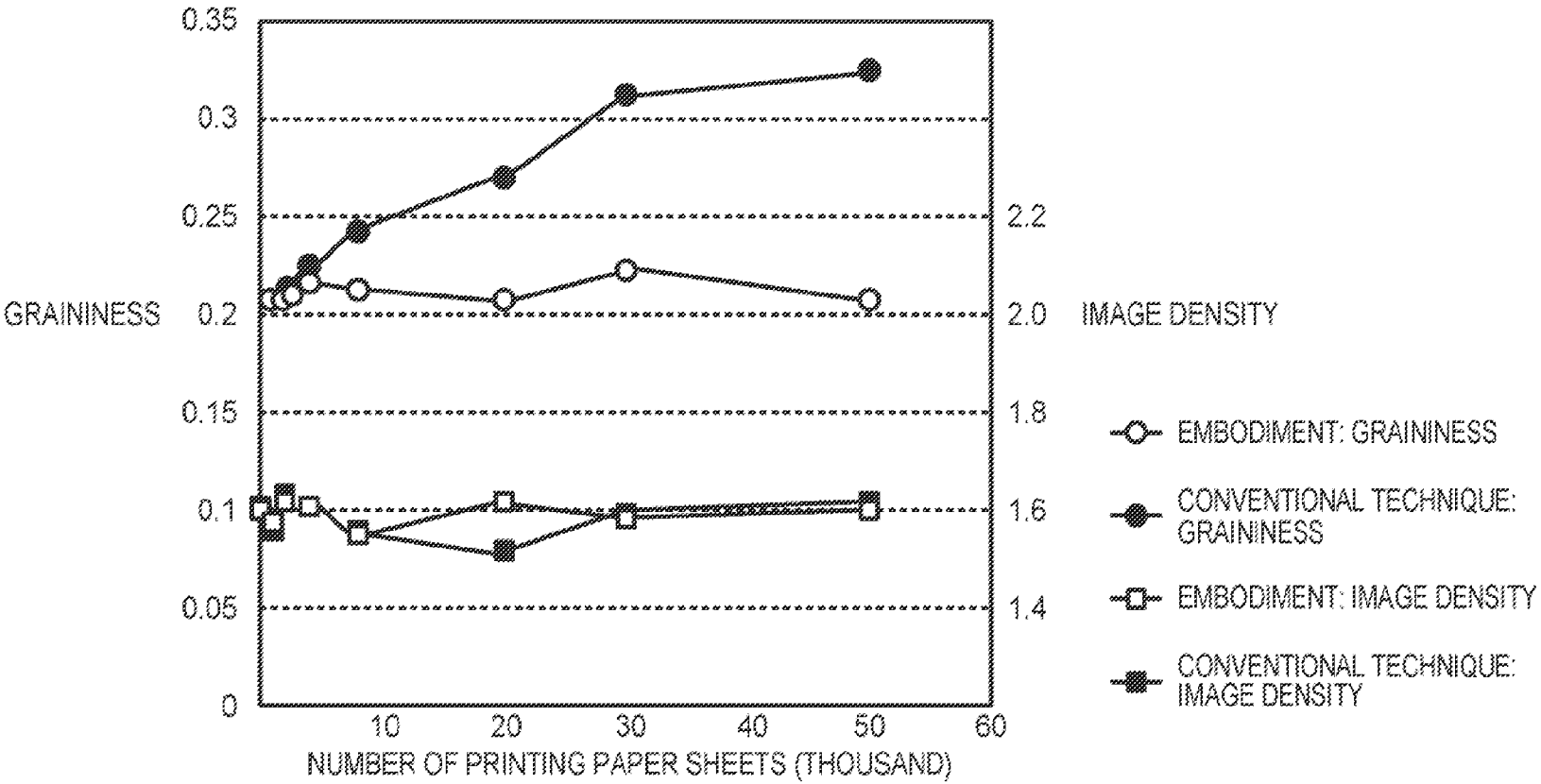
FIG. 11 is a graph showing a comparison of a conventional technique and the image forming apparatus according to the first embodiment.

The effects of the image forming apparatus according to the embodiment will be described. In this embodiment, to perform an image density control operation while keeping the graininess appropriate, the height of the toner layer on the intermediate transfer belt 21 is always measured and controlled. To check the effects of the present invention, image formation was executed for about 50 thousand paper sheets. FIG. 11 shows the result. It is found from FIG. 11 that it is possible to suppress degradation in graininess while controlling the image density.

The actual result will be described in more detail. In adjustment of the image density before image formation, the development contrast and the spot diameter of an exposure spot were determined. Note that the spot diameter was set to 50 μm. Since the height of the toner layer of the pattern image exceeded the permissible maximum value by 10 μm or more when about eight thousand paper sheets were printed, the spot diameter was changed to 55 μm. After that, the development contrast and the spot diameter of the exposure apparatus 3 were reset every time about one thousand paper sheets were printed, thereby forming an image.

In this embodiment, the latent image profile of lines or dots forming an image is controlled in consideration of the height of the toner layer. This enables to maintain halftone graininess while keeping the image density of a solid image portion constant.

Figure 12:
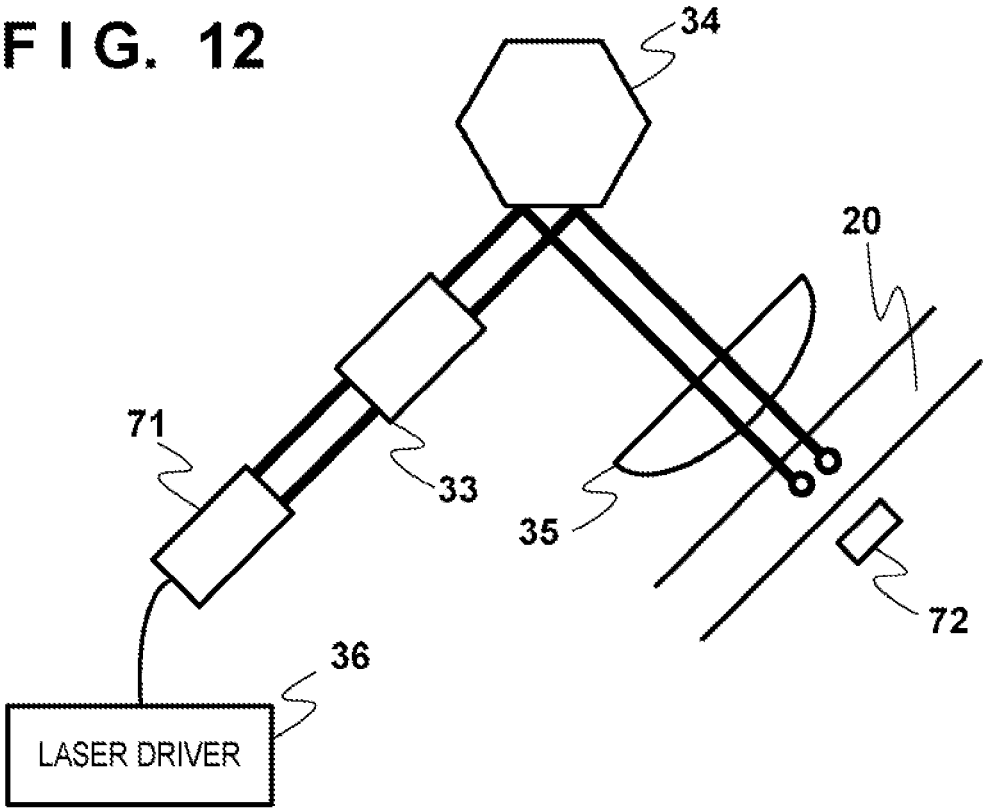
FIG. 12 is a schematic view showing an exposure apparatus according to the second embodiment.
Figure 13:
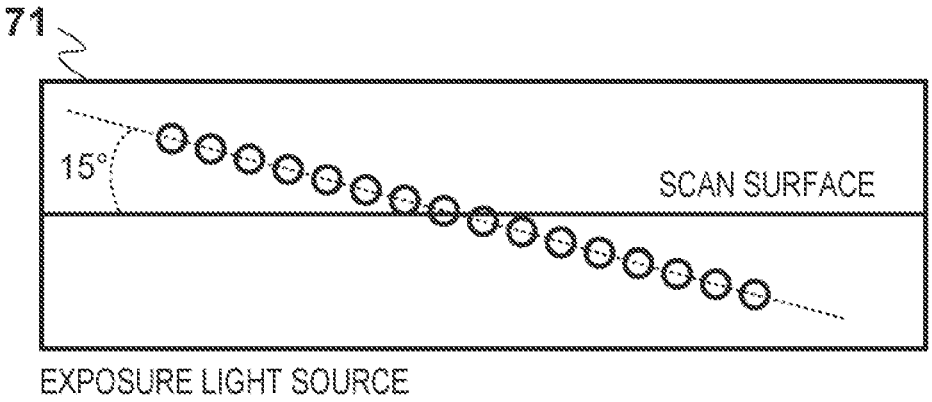
FIG. 13 is a view for explaining the exposure light source of the exposure apparatus according to the second embodiment.

The second embodiment will be described next. Note that the same elements as those in the first embodiment are denoted by the same reference numerals, and a detailed description thereof will be omitted. Although the exposure spot diameter of one laser beam is changed in the first embodiment, an exposure spot diameter is controlled using an overlap of the spots of two laser beams in this embodiment. As shown in FIG. 12, therefore, an exposure apparatus 3 according to this embodiment uses, as an exposure light source 71, a surface emitting laser having a plurality of laser light sources, for example, 16 laser light sources. Note that the 16 lasers are arranged on a straight line having an inclination of a predetermined angle, for example, 15° with respect to a scan surface, as shown in FIG. 13. The light amount distribution of an exposure spot, on a photosensitive drum 20, of each laser is Gaussian, and all the distributions are identical. The resolution of the exposure spot formed on the photosensitive drum 20 is, for example, 1200 dpi in both the main scanning direction and the sub-scanning direction of the laser. The spot diameter is, for example, 50 μm. A photodiode 72 detects a scan timing on the photosensitive drum 20.

Figure 14:
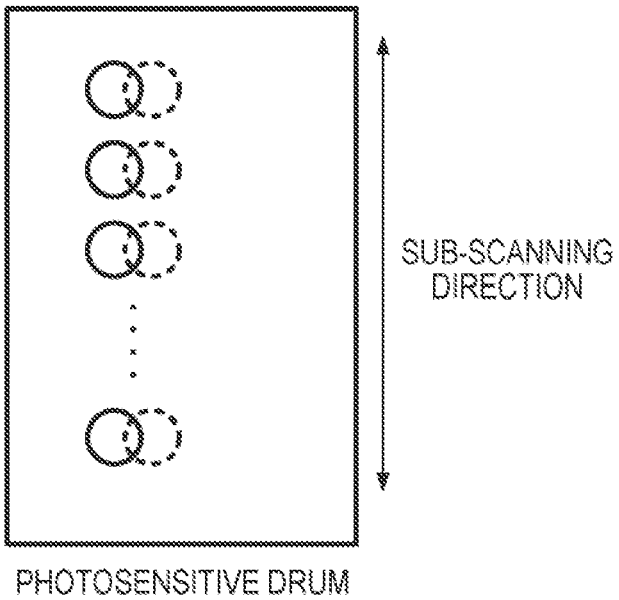
FIG. 14 is a view showing exposure spots according to the second embodiment.

A scan of the photosensitive drum 20 of the exposure apparatus 3 according to this embodiment will now be described. Solid-line circles in FIG. 14 represent spots which are generated on the photosensitive drum 20 when the 16 lasers of the exposure light source 71 start to scan a certain surface of a rotating polyhedral mirror 34. Since the emitting timings of the 16 lasers are different, the spots of the 16 lasers are linearly arranged in the sub-scanning direction of the photosensitive drum 20. A scan with the spots represented by the solid-line circles will be referred to as a first scan hereinafter. Dotted-line circles in FIG. 14 represent spots which are generated on the photosensitive drum 20 upon start of a scan by a surface of the polyhedral mirror 34 next to that used for the scan with the solid-line circles. A scan with the spots represented by the dotted-line circles will be referred to as a second scan hereinafter.

When scanning two continuous surfaces of the polyhedral mirror 34, an integrated light amount profile as a composition of exposure spots is formed on the photosensitive drum 20 by superimposing the spots on the photosensitive drum 20 with a small shift between the centers of the spots, as shown in FIG. 14. Note that this can be obtained by shifting the scan start timing of the second scan with respect to that of the first scan. Assume that Δ represents the distance between the centers of two spots, that is, a shift amount. In this case, it is possible to change the shift amount Δ between the centers of the spots according to a shift amount between the scan start timings of the first and second scans.

A functional block diagram showing an image forming apparatus according to this embodiment is the same as that shown in FIG. 6 in the first embodiment. A toner amount control method will be described below.

Figure 8:
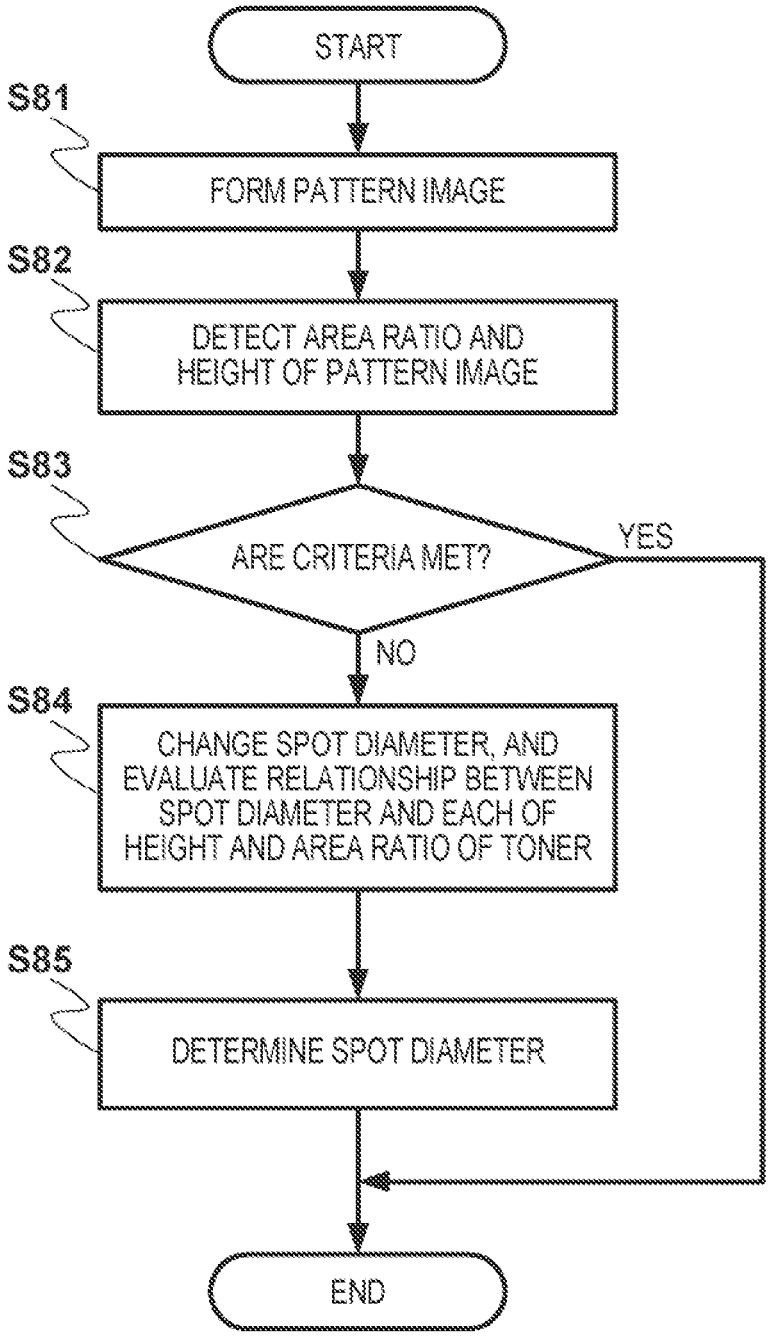
FIG. 8 is a flowchart illustrating a toner amount control operation according to the first embodiment.
Figure 15:
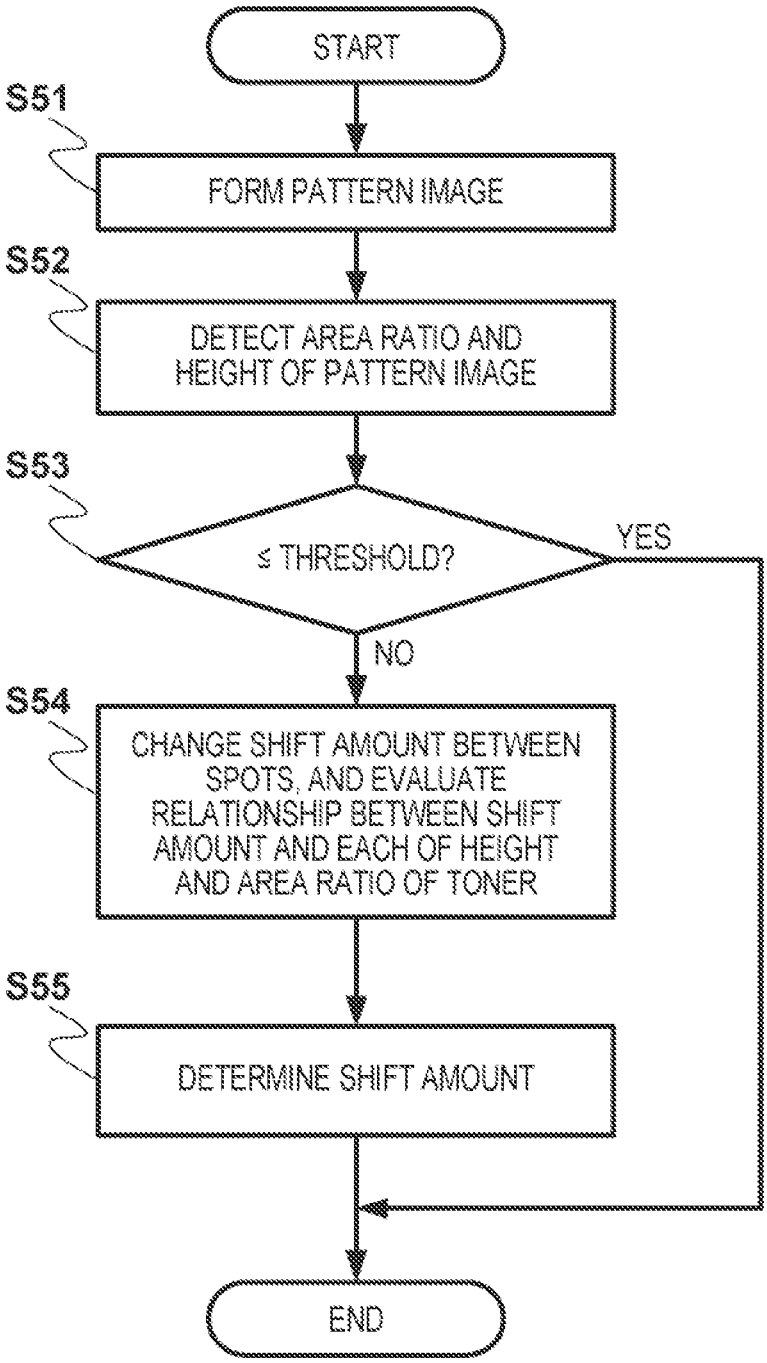
FIG. 15 is a flowchart illustrating a toner amount control operation according to the second embodiment.
Figure 16:
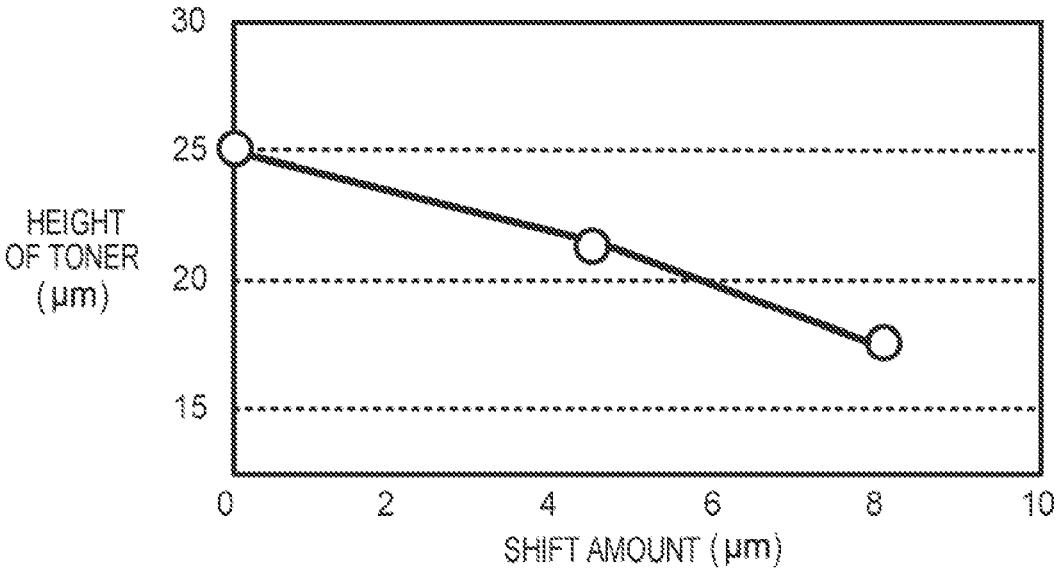
FIG. 16 is a graph showing the relationship between the height of toner and a shift amount between the centers of exposure spots.

Referring to FIG. 15, steps S51 to S53 are the same as steps S81 to S83 of FIG. 8 and a repetitive description thereof will be omitted. If criteria are not met in step S53, a shift amount is changed and the relationship between the shift amount and each of the height and the area ratio of the toner layer is evaluated in step S54. As described above, the shift amount is changed by changing a shift between the timings of the first and second scans. More specifically, a control unit 1 forms a pattern image by increasing/decreasing the shift amount from the current setting by a predetermined value, and measures the height and the area ratio of the toner layer, thereby finding a shift amount with which both the height and the area ratio meet the criteria. FIG. 16 is a graph showing the relationship between the shift amount and the height. Note that as the relationship shown in FIG. 16 changes due to a change in film thickness of the photosensitive drum 20 or a change in developability, it is necessary to check the relationship for each control operation. The control unit 1 sets the shift between the timings of the first and second scans to obtain a shift amount between the centers of the spots when the height of the toner layer falls within the permissible range.

Figure 17:
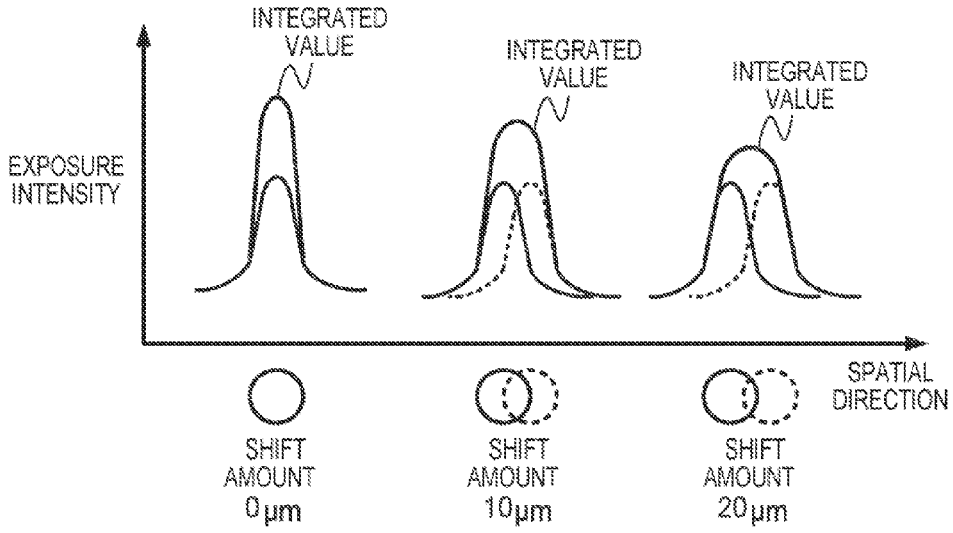
FIG. 17 is a graph showing the relationship between an exposure profile and a shift amount between exposure spots.

In this embodiment, the gradient of a latent image profile on the development potential surface and a depth with respect to the development potential surface are controlled by changing the shift amount between the centers of the spots of the exposure apparatus 3 to change the profile of an integrated light amount. The influence of the shift amount exerted on an exposure profile and the latent image profile will be described below. FIG. 17 shows a simulation result for the exposure profile when the shift amount is set to 0, 10, and 20 μm. As the shift amount increases, the gradient of the exposure profile and the peak value of a peak light amount decrease. Note that if the shift amount is made too large, the exposure profile has a form including two peaks but is used within a range where two peaks do not appear.

Figure 18:
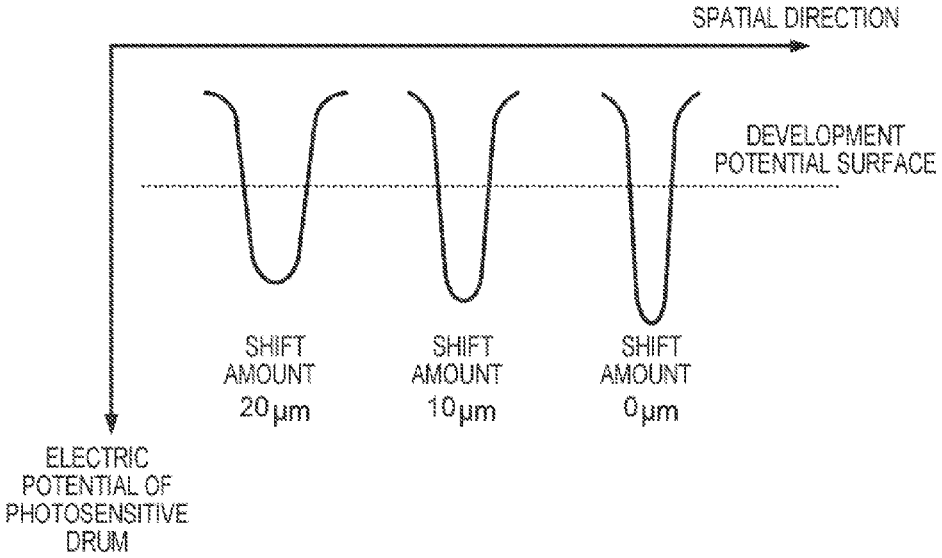
FIG. 18 is a graph showing the relationship between a latent image profile and a shift amount between exposure spots.

Furthermore, FIG. 18 shows a simulation result for a latent image profile of one dot when the shift amount between the spots is set to 0, 10, and 20 μm. Note that the film thickness of the photosensitive drum 20 is set to 25 μm. An exposure condition in the simulation is that the development contrast for solid black formed by one dot is constant when an integrated light amount profile of the dot is formed by the first and second scans. It is found from FIG. 18 that as the shift amount between the spots increases, a latent image which has a smaller gradient of the latent image profile on the developing electric surface and a shallower depth with respect to the developing electric potential is obtained. That is, as the shift amount is made larger, the area of the toner layer becomes larger and the height becomes lower.

As described above, it is also possible to control the height and the area of the toner layer by changing a shift amount between the centers of the spots of two beams.

Figure 19:
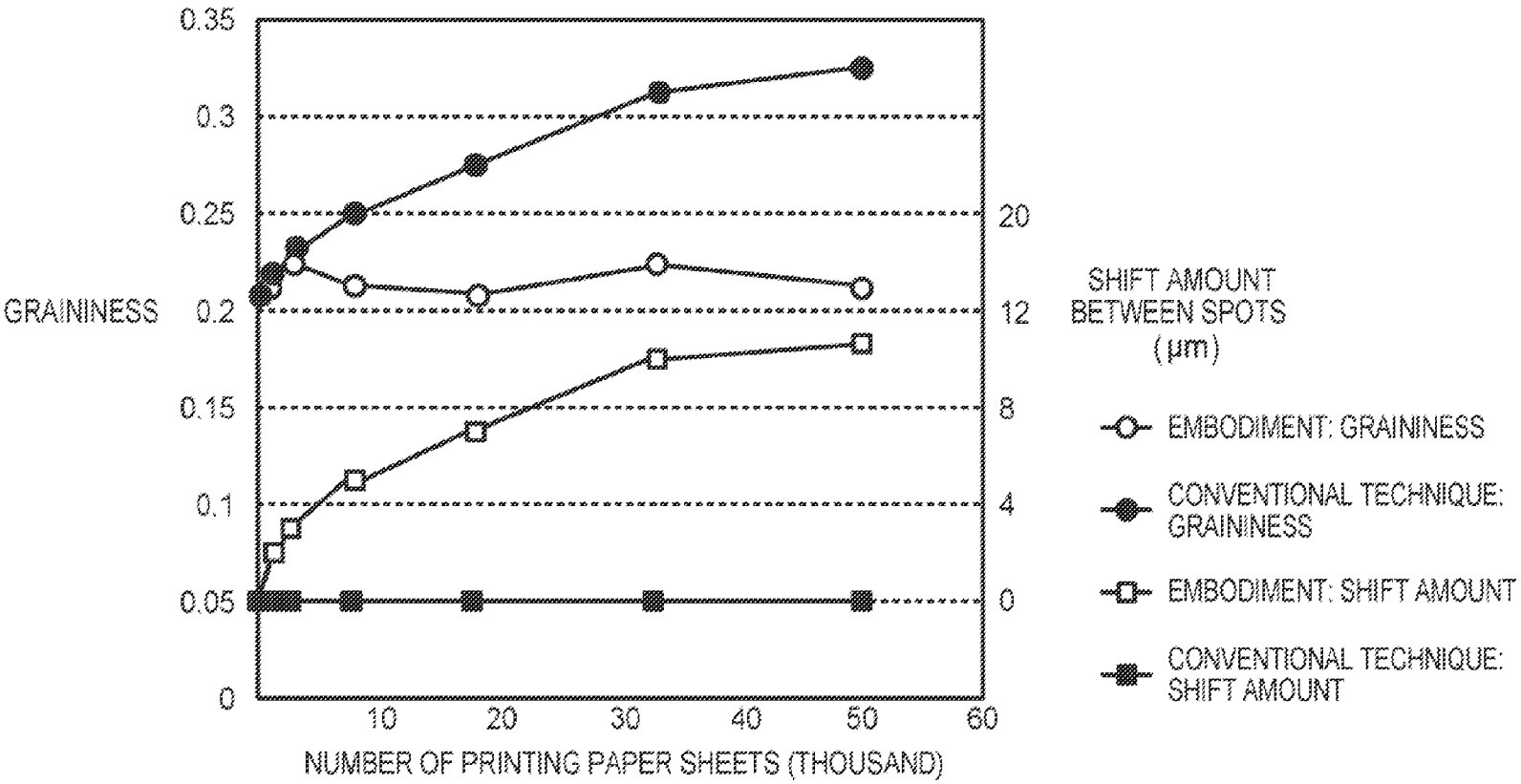
FIG. 19 is a graph showing a comparison of the conventional technique and the image forming apparatus according to the second embodiment.

The effects of the image forming apparatus according to this embodiment will be described. To check the effects, image formation was executed for about 50 thousand paper sheets. FIG. 19 shows the result. It is found from FIG. 19 that the graininess degrades as the number of printing paper sheets increases if one spot is used (the shift amount is 0). To deal with this problem, the image forming apparatus according to this embodiment prevents the graininess from degrading by changing the shift amount.

With the above-described arrangement, the image forming apparatus can keep the height of a toner layer on the photosensitive drum 20 constant. This can suppress degradation in graininess due to use over time, a change in environment, and deterioration of a chemical material such as a developer, and can maintain the image quality.

Other Embodiments

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-133537, filed on Jun. 15, 2011, which is hereby incorporated by reference herein in its entirety.

What is claimed is:

1. An image forming apparatus comprising:

an image forming unit including an exposure unit configured to form a latent image by exposing a photosensitive member with a laser beam, and a developing unit configured to form a toner image by causing toner to adhere to the latent image;

a detection unit configured to detect a thickness and an area ratio of a toner layer of a pattern image as the toner image formed by the image forming unit;

a storage unit configured to store data indicating permissible ranges for the thickness and the area ratio of the toner layer; and a correction unit configured to change, when the thickness or the area ratio of the toner layer detected by the detection unit falls outside the corresponding permissible range indicated by the data stored in the storage unit, a spot diameter of the laser beam so that the thickness and the area ratio of the toner layer respectively fall within the permissible ranges, wherein the correction unit comprises a lens arranged on an optical path of the laser beam between the photosensitive member and the exposure unit, and an adjustment unit configured to move the lens along the optical path of the laser beam.

2. An image forming apparatus comprising:

an image forming unit including an exposure unit configured to form a latent image by exposing a photosensitive member with a laser beam, and a developing unit configured to form a toner image by causing toner to adhere to the latent image;

a detection unit configured to detect a thickness and an area ratio of a toner layer of a pattern image as the toner image formed by the image forming unit;

a storage unit configured to store data indicating permissible ranges for the thickness and the area ratio of the toner layer; and a correction unit configured to change, when the thickness or the area ratio of the toner layer detected by the detection unit falls outside the corresponding permissible range indicated by the data stored in the storage unit, a spot diameter of the laser beam so that the thickness and the area ratio of the toner layer respectively fall within the permissible ranges, wherein the correction unit is further configured to control a distance between centers of spots of a plurality of laser beams of the exposure unit.

3. The apparatus according to claim 1, wherein the detection unit is further configured to detect the thickness based on a difference between a peak position of a reflected light amount when a position where the pattern image is not formed is irradiated with a laser beam and a peak position of a reflected light amount when a position of the pattern image is irradiated with a laser beam, and detect the area ratio based on a difference between a reflected light amount when a position where the pattern image is not formed is irradiated with a laser beam and a reflected light amount when a position of the pattern image is irradiated by a laser beam.

4. The apparatus according to claim 1, wherein a change amount of a product of a thickness and an area ratio after changing the spot diameter with respect to a product of the detected thickness and area ratio is not larger than a threshold.

* * * * *